US008201672B2

(12) United States Patent
Yang

(10) Patent No.: US 8,201,672 B2
(45) Date of Patent: Jun. 19, 2012

(54) ENHANCED STRUCTURE FOR BASE WITH ROLLER AND BELT OF HARDSHELL ZIPPER CASE

(76) Inventor: Sheng Cho Yang, Hsinchu (TW)

( * ) Notice: Subject to any disclaimer, the term of this patent is extended or adjusted under 35 U.S.C. 154(b) by 444 days.

(21) Appl. No.: 12/574,977

(22) Filed: Oct. 7, 2009

(65) Prior Publication Data

US 2011/0079479 A1 Apr. 7, 2011

(51) Int. Cl.
*A45C 5/14* (2006.01)

(52) U.S. Cl. ..... 190/18 A; 190/101; 190/108; 190/103; 16/32; 16/33; 280/37; 280/47.24; 280/47.2

(58) Field of Classification Search ..... 190/18 A, 190/101, 108, 103; 16/32, 33; 280/37, 47.24, 280/35, 47.371, 47.315, 655, 47.2
See application file for complete search history.

(56) References Cited

U.S. PATENT DOCUMENTS 672,173 A * 4/1901 Le Fevre ..... 190/102
2,581,417 A * 1/1952 Jones ..... 280/645
3,349,425 A * 10/1967 Reabelos ..... 16/44
4,103,391 A * 8/1978 Thomsen ..... 16/33
5,890,571 A * 4/1999 Sadow ..... 190/102
5,956,805 A * 9/1999 Huang ..... 16/33
5,988,334 A * 11/1999 Caruso ..... 190/18 A
6,193,033 B1 * 2/2001 Sadow et al. ..... 190/18 A
6,604,615 B2 * 8/2003 Wu ..... 190/18 A
7,356,877 B2 * 4/2008 Kim et al. ..... 16/32

* cited by examiner

*Primary Examiner* — Tri Mai
(74) *Attorney, Agent, or Firm* — Rabin & Berdo, P.C.

(57) ABSTRACT

An enhanced structure for the base with roller and belt of hardshell zipper case is provided, including a hardshell zipper case main body, a plurality of hidden roller units, a retractable belt unit, and an auxiliary wheel set. The hidden roller units and the retractable belt unit are placed inside the roller housing trench and the belt housing trench located at the bottom of the hardshell zipper case main body. When the hidden roller units are not in use, the roller units are entirely hidden inside the roller housing trench so that the roller unit will not be damaged due to careless handling. To move the hardshell zipper case, the outer rim of the roller units are exposed outside of the surface of the roller housing trench so that the roller units can roll along when moved. The belt of retractable belt unit can be easily pulled out from one end of the bottom of the hardshell zipper case. After surrounding the hardshell zipper case main body with the belt, the belt can be fastened to the other end of the retractable belt unit. In this manner, the belt can be easily pulled out for fastening the case when necessary, and can be retracted when not in use.

10 Claims, 11 Drawing Sheets

ENHANCED STRUCTURE FOR BASE WITH ROLLER AND BELT OF HARDSHELL ZIPPER CASE

FIELD OF THE INVENTION

The present invention generally relates to a hardshell zipper case, and more specifically to an enhanced structure for the base with roller and belt of hardshell zipper case.

BACKGROUND OF THE INVENTION

Suitcases have been an indispensable gear for both long and short distance travels as the traveler can easily choose suitcases of different sizes for the trip. The mobility of the suitcase comes from the roller installed at the base of suitcase so that the suitcase can be pushed or pulled around. In this manner, the traveler can easily load the suitcase with appropriate items and carry around without actually burdened with the weight. However, one common problem of a suitcase is that the rollers at the base of the suitcase may be damaged after many luggage handlings at by the airliners. This may cause the trouble for the roller to roll smoothly. Another common problem is that the suitcase may crack when overstuffed or inappropriately handled. In this case, the traveler usually would be an additional belt to band around the waist of the suitcase to prevent the suitcase from cracking. This is neither convenient nor effective most of the time.

Furthermore, more and more travelers will purchase the so-called expandable suitcase to accommodate the anticipated extra purchases during the trip. The so-called expandable suitcase usually can be categorized as a general business travel expandable suitcase or a hardshell expandable suitcase. The rollers of the hardshell are placed at the bottoms of two separate case body parts, which are connected by, for example, zipper, to form a complete expandable suitcase. By zipping and unzipping the zipper, the space in the suitcase can contract or expand to accommodate different load of items for traveling. As the rollers are placed at the bottom of the two separate case body parts, it is usually difficult to maneuver the rollers, especially when the suitcase is fully loaded.

SUMMARY OF THE INVENTION

The present invention has been made to overcome the aforementioned drawback of conventional suitcase. The present invention provides an enhanced structure for base with roller and belt of hardshell zipper case to improve the durability of the rollers and the convenience of the belt.

The primary object of the present invention is to prevent the rollers of the hardshell zipper case from damage by the careless shipping and handling.

Another object of the present invention is to integrated the belt to the hardshell zipper case to improve the convenience of use.

Yet another object of the present invention is to improve the practicality of the hardshell zipper case.

To achieve the aforementioned objects, the present invention provides an enhanced structure for the base with roller and belt of hardshell zipper case, including a hardshell zipper case main body, a plurality of hidden roller units, a retractable belt unit, and an auxiliary wheel set. The hidden roller units and the retractable belt unit are placed inside the roller housing trench and the belt housing trench located at the bottom of the hardshell zipper case main body. When the hidden roller units are not in use, the roller units are entirely hidden inside the roller housing trench so that the roller unit will not be damaged due to careless handling. To move the hardshell zipper case, the outer rim of the roller units are exposed outside of the surface of the roller housing trench so that the roller units can roll along when moved. The belt of retractable belt unit can be easily pulled out from one end of the bottom of the hardshell zipper case. After surrounding the hardshell zipper case main body with the belt, the belt can be fastened to the other end of the retractable belt unit. In this manner, the belt can be easily pulled out for fastening the case when necessary, and can be retracted when not in use.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

Figure 1:
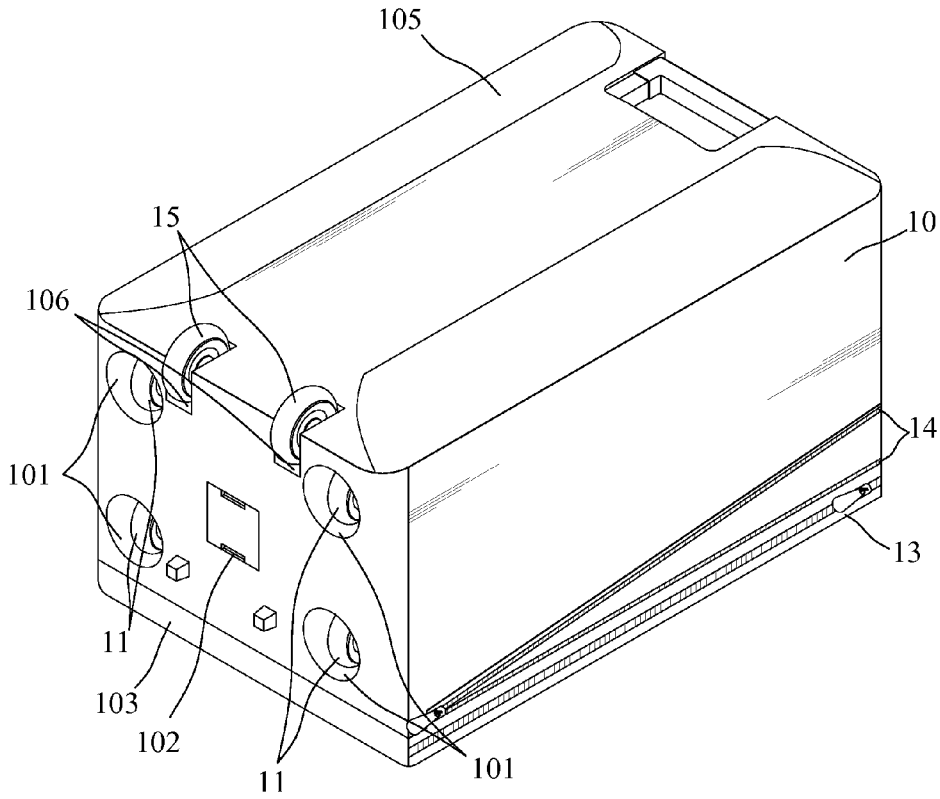
FIG. 1 shows a schematic view of a hardshell zipper case according to the present invention.
Figure 2:
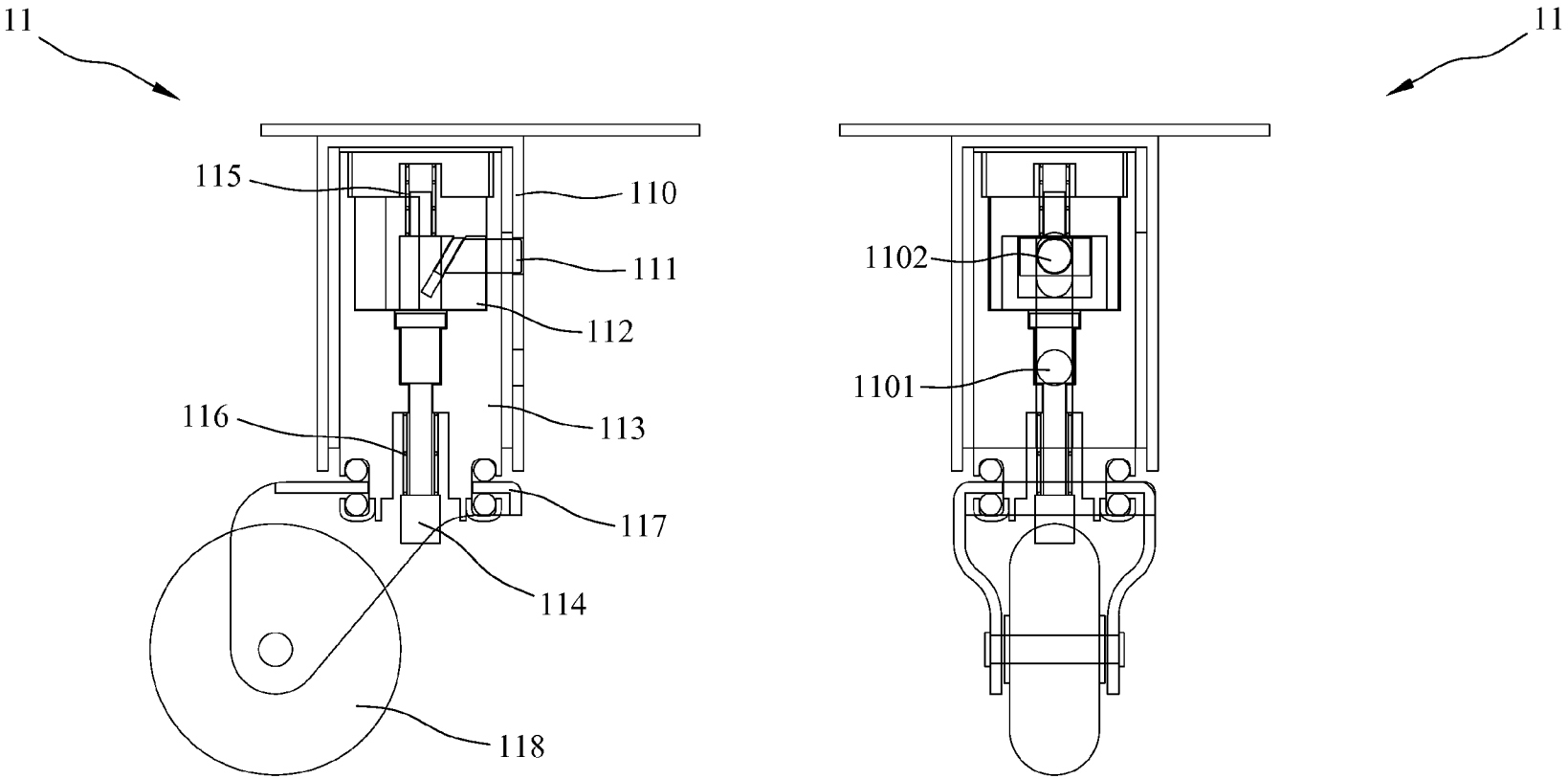
FIG. 2 shows a schematic of the elements of hidden roller unit of the present invention.

Refer to FIG. 1 and FIG. 2. FIG. 1 shows a schematic view of a hardshell zipper case of the present invention, and FIG. 2 shows a schematic view of the elements of hidden roller units of the present invention. As shown in FIG. 1, hardshell zipper case includes a hardshell zipper case main body 10, a plurality of hidden roller units 11, a retractable belt unit 12 (now shown), a hardshell lid 13, and an expanding unit 14. Hardshell zipper case main body 10 includes a plurality of roller housing trenches 101, a belt housing trench 102 and at least an auxiliary wheel trench 106, located respectively at main body bottom 103 of hardshell zipper case main body 10. An auxiliary wheel set 15 is placed inside auxiliary wheel trench 106, located at main body bottom 103. The outer rim of auxiliary wheel set 15 is convex above the surface of main body back 105. Expanding unit 14 is connected between hardshell zipper case main body 10 and hardshell lid 13. Hidden roller unit 11 and retractable belt unit 12 are fastened inside roller housing trench 101 and belt housing trench 102.

Hardshell zipper case main body 10 is a monolithic design, and is usually manufactured by injection molding. Hardshell zipper case main body 10 and hardshell lid 13 can be made of material, such as, Acrylonitrile-Butadene-Styrene (ABS), Polyethylene (PE), Polypropylene (PP) or Polycarbonates (PC).

Accordingly, as shown in FIG. 2, hidden roller unit 11 includes a jacket 110, a positioning bolt 111, a positioning bolt slider 112, a sliding axis 113, a positioning bolt retractable rod 114, an upper spring 115, a lower spring 116, a roller set 117 and a roller 118. Jacket 110 includes a first positioning bolt fasten hole 1101 and a second positioning bolt fasten hole 1102.

Positioning bolt retractable rod 114 is placed inside the connected sliding axis 113 and positioning bolt slider 112, having lower spring 116 placed between the lower part and sliding axis 113 and upper spring 115 placed between the upper part and positioning bolt slider 112. Positioning bolt 111 is placed on one side of positioning bolt slider 112, on the same side as first positioning bolt fasten hole 1101 and second positioning bolt fasten hole 1102. The above elements are all placed inside jacket 110. The bottom of sliding axis 113 is connected to roller set 117 with roller 118.

By pressing positioning bolt retractable rod 114, positioning bolt slider 112 moves up and positioning bolt 111 retracts. Entire sliding axis 113 can slide up and down. When positioning bolt 111 reaches first positioning bolt fasten hole 1101 or second positioning bolt fasten hole 1102, the pressure on positioning bolt retractable rod 114 can be relieved and upper spring 115 and lower spring 116 can position hidden roller unit 11 to the desired position. When positioning bolt 111 is fastened to first positioning bolt fasten hole 1101, roller 118 is exposed above the surface of main body bottom 103 (not shown) and can roll on the ground. On the other hand, when positioning bolt 111 is fastened to second positioning bolt fasten hole 1102, roller 118 is hidden under the surface of main body bottom 103 (not shown) to avoid damage during handling.

Figure 3:
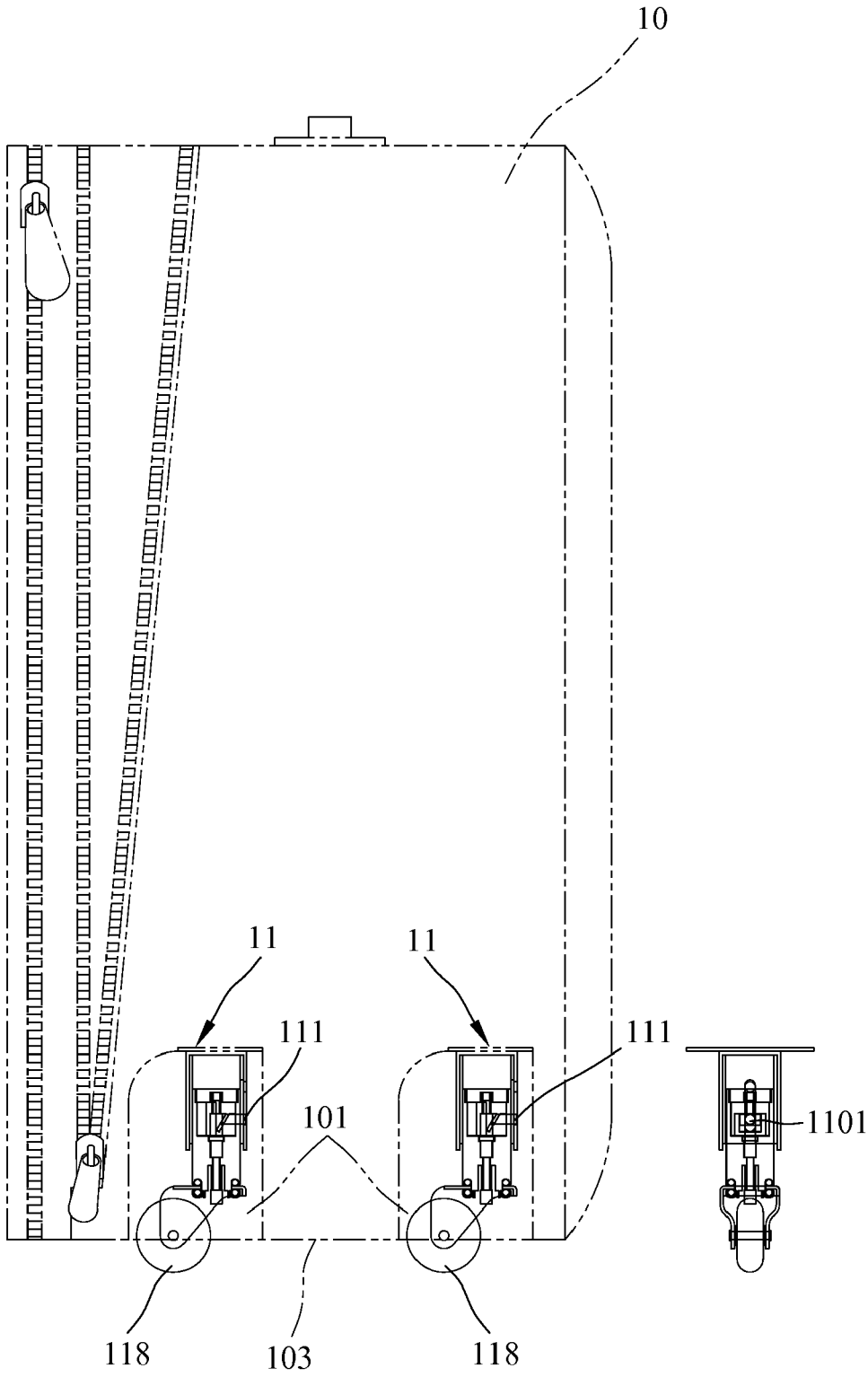
FIG. 3 shows a schematic view of the hidden roller unit in use when moving the case according to the present invention.

FIG. 3 shows a schematic view of hidden roller unit in non-hidden state. As shown in FIG. 3, hidden roller unit 11 is fastened inside roller housing trench 101 and positioning bolt 111 is fastened to first positioning bolt fasten hole 1101. At this point, roller 118 is exposed above the surface of main body bottom 103 of hardshell zipper case main body 10, and hardshell zipper case main body 10 can be moved by roller 118 rolling along the ground.

Figure 4:
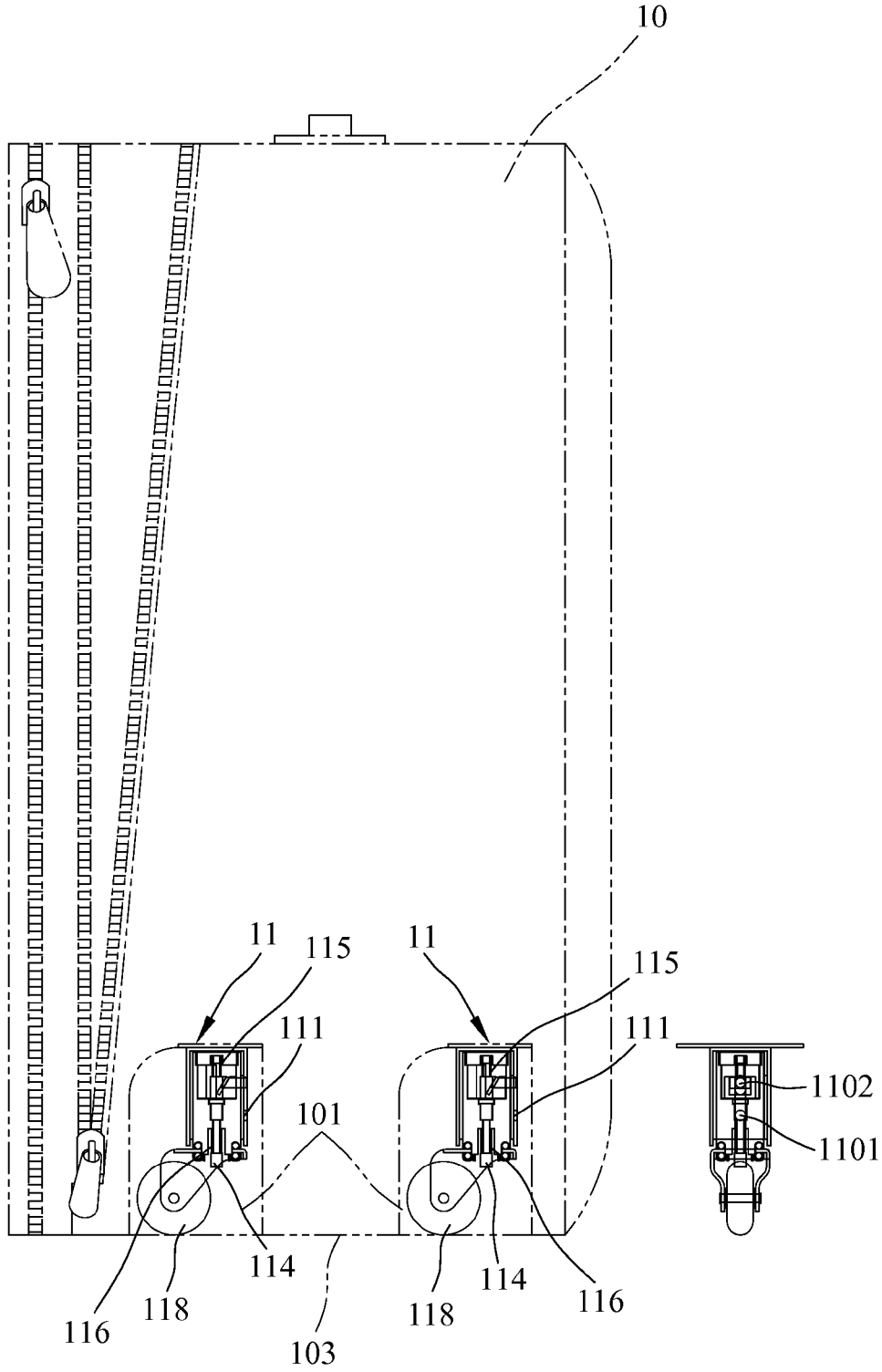
FIG. 4 shows a schematic view of the hidden roller unit when the case being parked according to the present invention.

Accordingly, FIG. 4 shows a schematic view of hidden roller units in hidden state. As shown in FIG. 4, by pressing positioning bolt retractable rod 114, positioning bolt 111 can be moved from first positioning bolt fasten hole 1101 to second positioning bolt fasten hole 1102. By releasing positioning bolt retractable rod 114, upper spring 115 and lower spring 116 acts to restore hidden roller unit 11 and positioning bolt 111 can be fastened to second positioning bolt fasten hole 1102. At this point, roller 118 is completely inside roller housing trench 101, and thus main body bottom 103 is flat without any convex object protruding.

Figure 5:
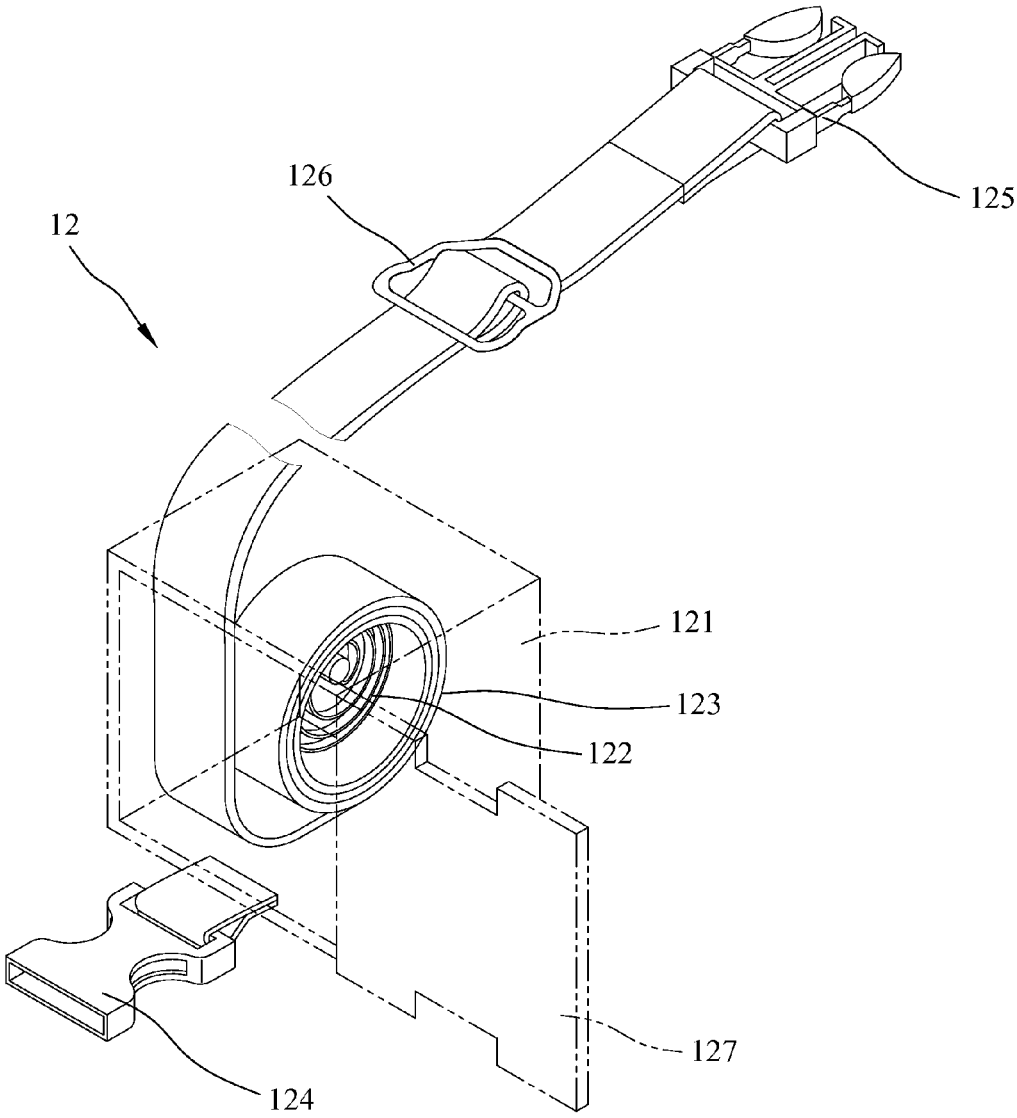
FIG. 5 shows a schematic view of the elements of the retractable belt unit of the present invention.

FIG. 5 shows a schematic view of retractable belt unit of the present invention. As shown in FIG. 5, retractable belt unit 12 includes an outer box 121, a spring roll 122, a belt 123, a first fasten element 124, a second fasten element 125, an adjustment element 126 and an outer lid 127. The inside of outer box 121 includes spring roll 122 and belt 123. Outer lid 127 is fixed to outer box 121 so as to conceal the elements placed inside outer box 121. One end of spring roll 122 is fastened to a specific position of outer box 121, and the other end is connected to one end of belt 123. The other end of belt 123 is connected to first fasten element 124. Adjustment element 126 is placed on a non-specific location of belt 123 to adjust the length of belt 123. After pulling belt 123 out of outer box 121 to a specific length, spring roll 122 can fix the length of belt 123. When belt 123 is pulled again to a specific strength, spring roll 122 will retract belt 123 into outer box 121, where outer lid 127 can be placed to conceal the entire retractable belt unit 12 and provide protection to first fasten element 124 and second fasten element 125.

Figure 6:
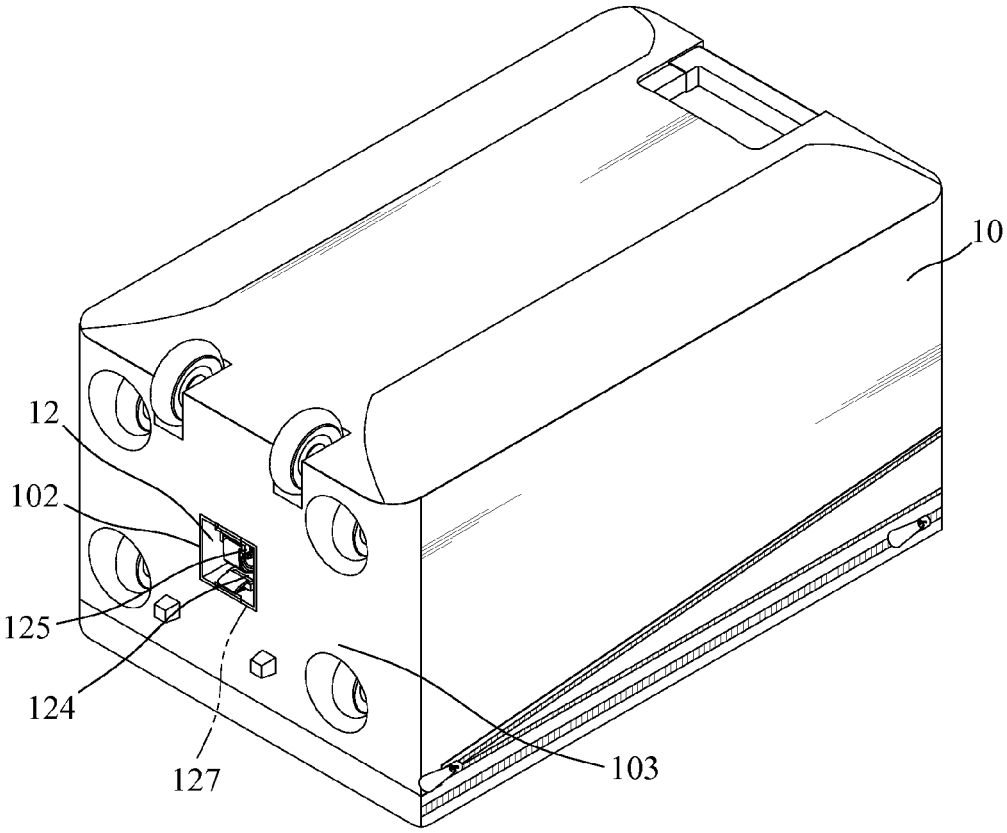
FIG. 6 shows a schematic view of the locations of retractable belt unit and hardshell zipper case of the present invention.

FIG. 6 shows a schematic view of the position of retractable belt unit and hardshell zipper case of the present invention. As shown in FIG. 6, retractable belt unit 12 is fixed to the inside of belt housing trench 102 at main body bottom 103 of hardshell zipper case main body 10. Second fasten element 125 is fixed to a specific position on outer box 121, with the direction opposite to the direction of first fasten element 124. When releasing the engagement of first fasten element 124 and second fasten element 125 and the belt 123 being pulled to a specific strength, spring roll 122 will retract belt 123 into outer box 121.

Figure 7:
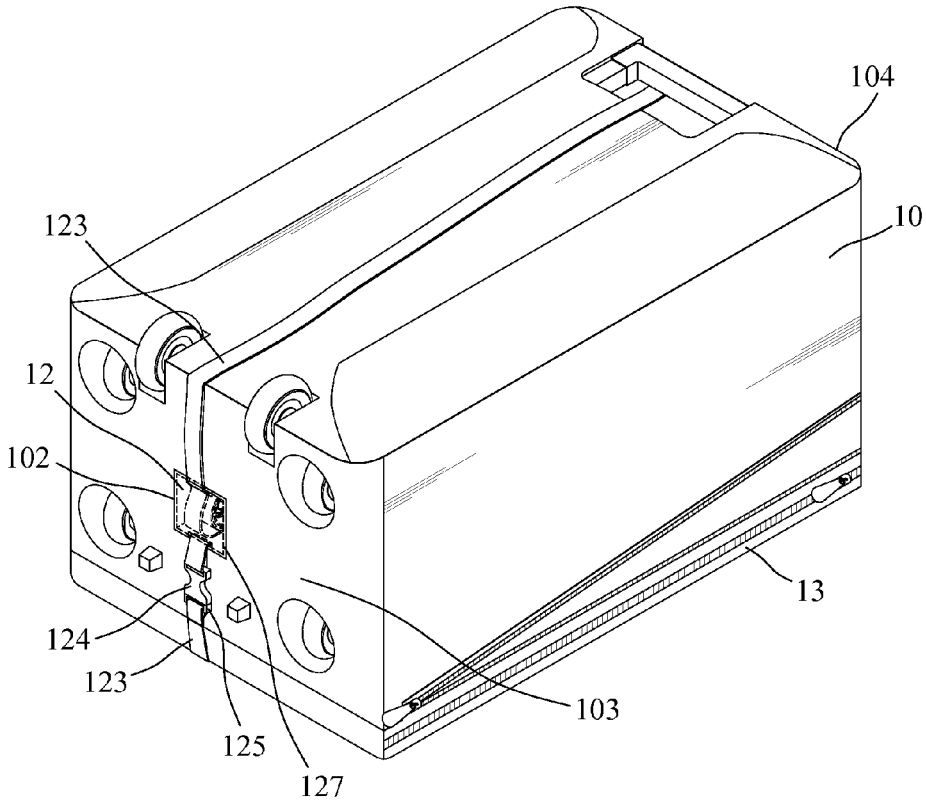
FIG. 7 shows a schematic view of the retractable belt unit in actual application according to the present invention.

FIG. 7 shows a schematic view of retractable belt unit in use. As shown in FIG. 7, pulling first fasten element 124 will also draw belt 123. By drawing belt 123 around main body upper part 104 of hardshell zipper case main body 10 and hardshell lid 13 to main body bottom 103, first fasten element 124 can then be engaged to second fasten element 125. In this manner, belt 123 is tightly surrounding hardshell zipper case main body 10 and hardshell lid 13 to prevent the hardshell zipper case from cracking.

Figure 8:
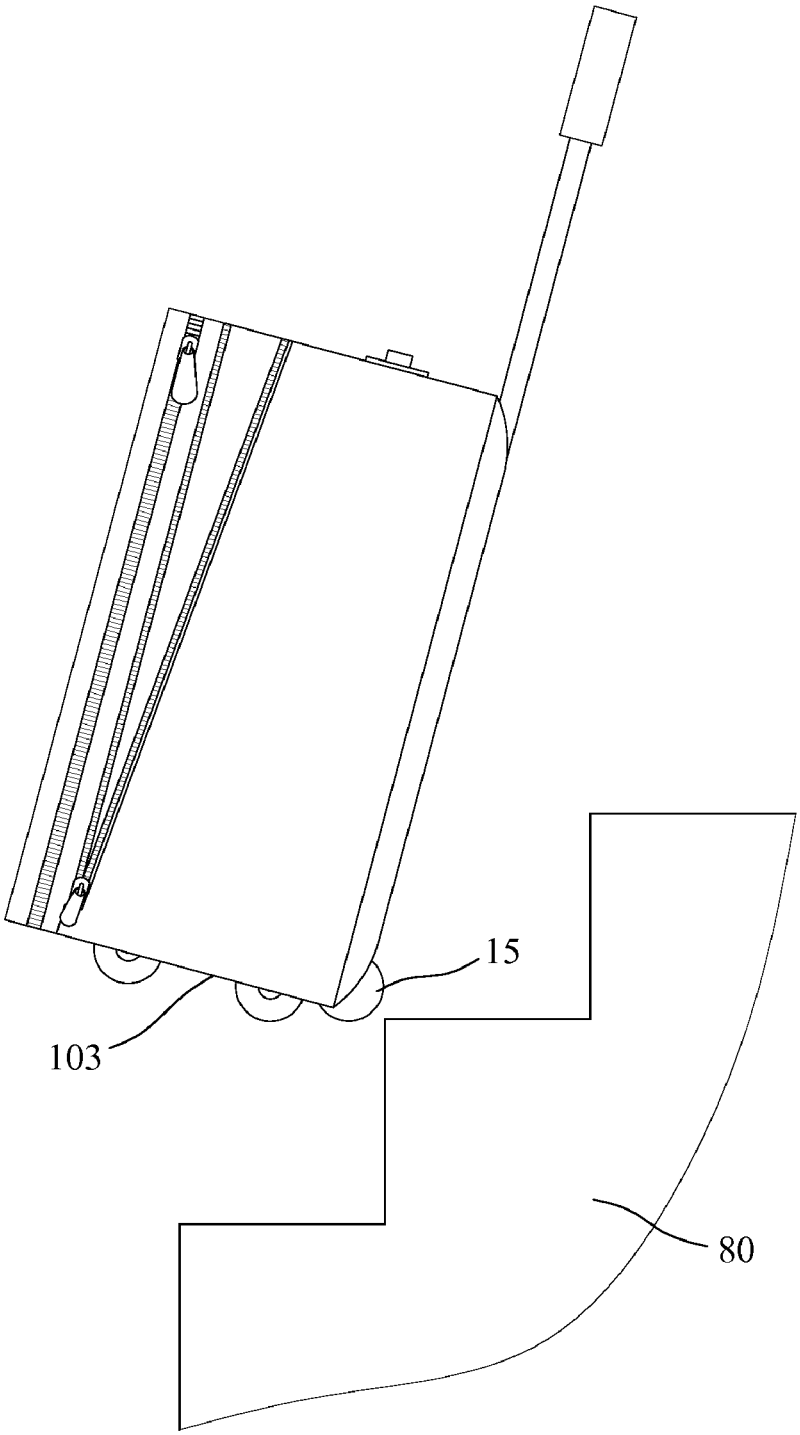
FIG. 8 shows a schematic view of the auxiliary wheel set applied to stairs.

FIG. 8 shows a schematic view of using auxiliary wheel set on stairs. As shown in FIG. 8, auxiliary wheel set 15 is located at main body bottom 103, between roller unit 11 and main body back 105 with outer rim above the surface of main body back 105. When the user pulls the hardshell zipper case on stairs 80, auxiliary wheel set 15 can roll along the surface of stairs 80 so that the user can exert less force to pull the hardshell zipper case upwards. At the same time, auxiliary wheel set 15 can prevent the hardshell zipper case from damage caused by abrasion with stairs 80.

Figure 9:
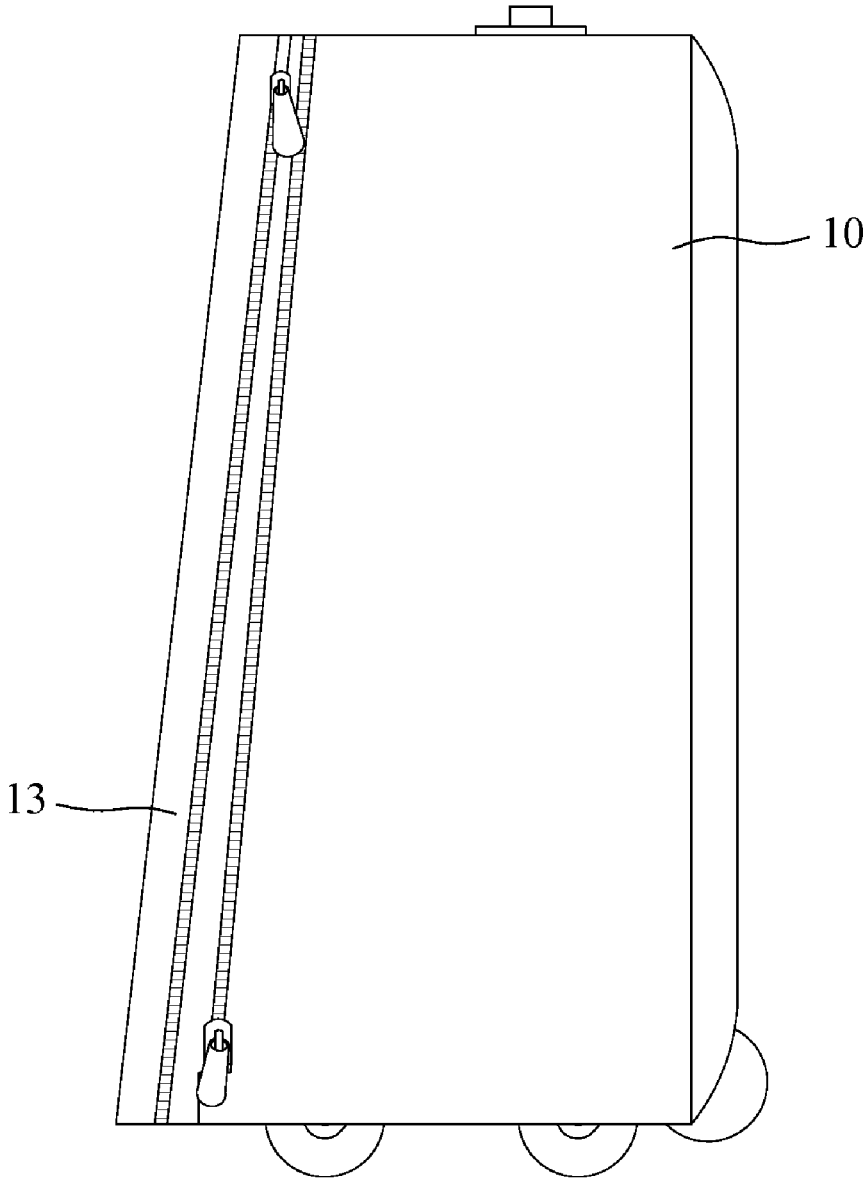
FIG. 9 shows a schematic side view of the hardshell zipper case of the present invention.
Figure 10:
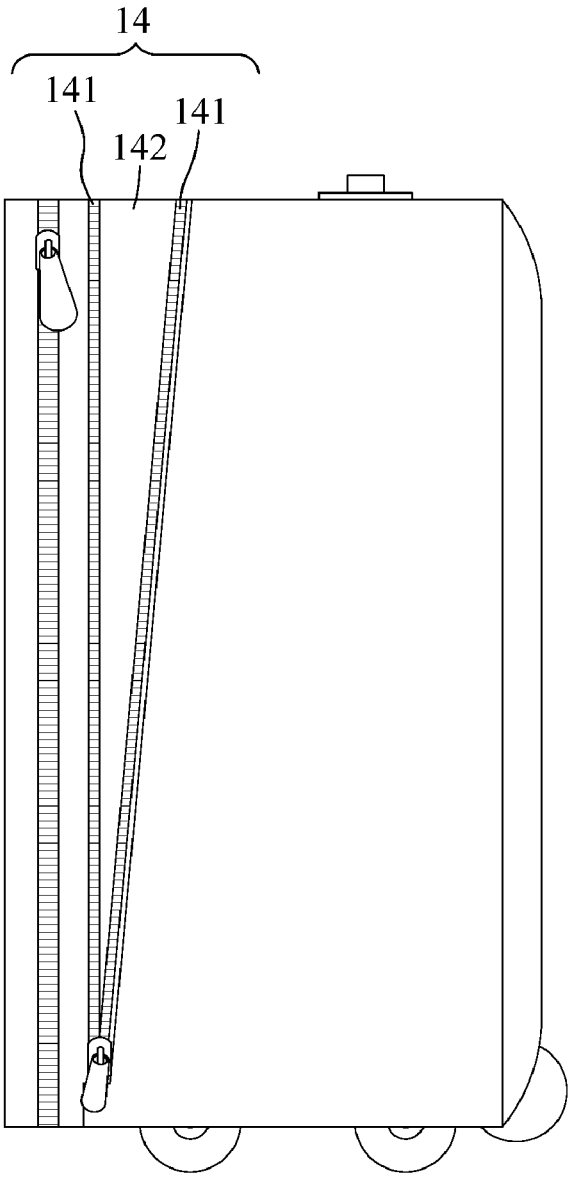
FIG. 10 shows a schematic view of the hardshell zipper case of the present invention after expansion.

Refer to FIG. 9 and FIG. 10. FIG. 9 shows a schematic side view of the hardshell zipper case of the present invention, and FIG. 10 shows a schematic view of the hardshell zipper case after expansion. As shown in FIG. 9, the upper part of hardshell lid 13 tilts towards hardshell zipper case main body 10; hence, the hardshell zipper case has a smaller top and a bigger bottom, similar to a trapezoid with a right angle. As shown in FIG. 10, after expanding unit 14 is expanded, expanding zipper 141 is located on two sides of expanding part 142 and the shape of hardshell zipper case changes. Because expanding part 142 increases the width of the upper part of the hardshell zipper case, the expanded hardshell zipper case has a rectangular shape.

Figure 11:
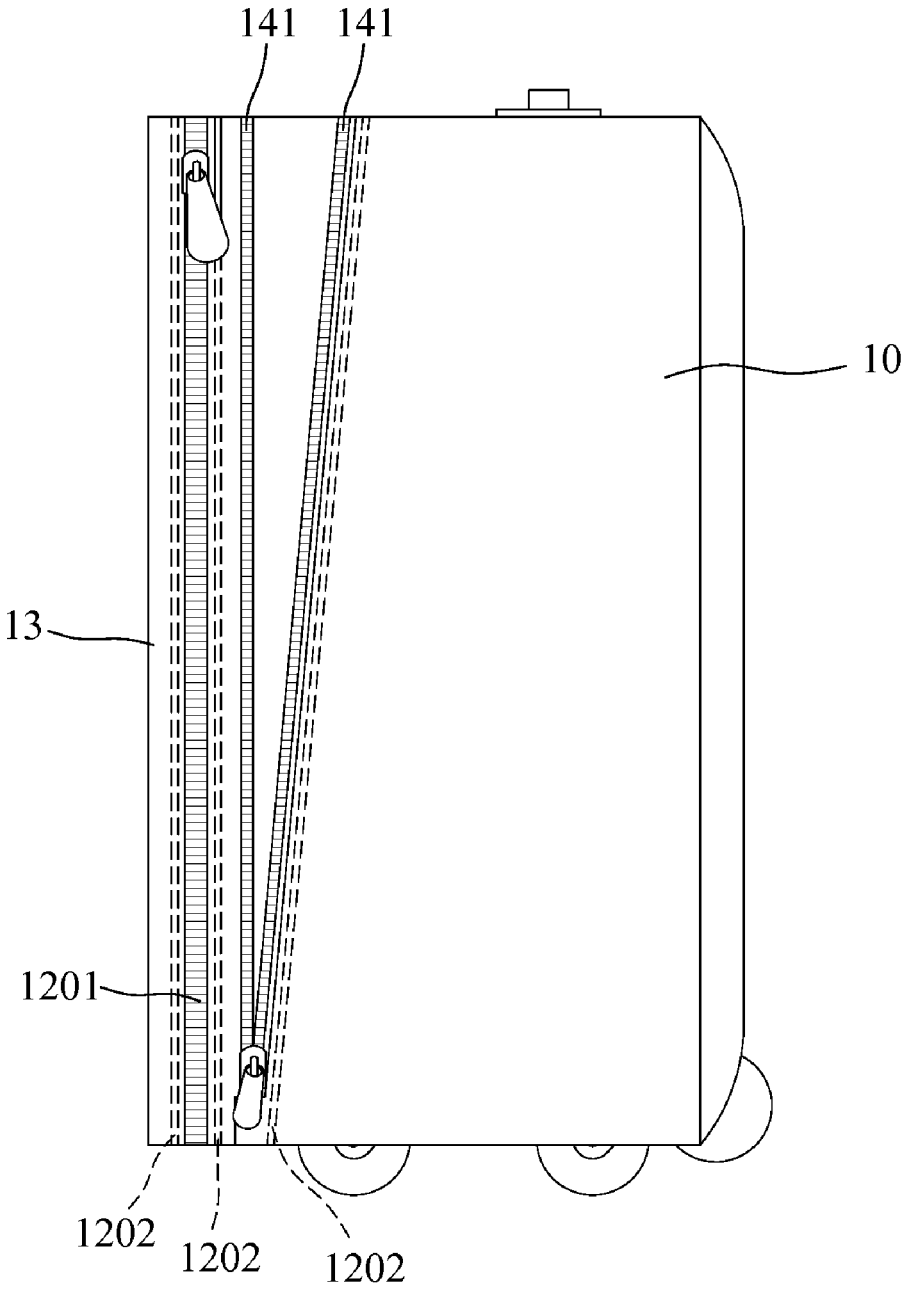
FIG. 11 shows a schematic view of the enhancement elements of the present invention.

FIG. 11 shows a schematic view of enhancement elements. As shown in FIG. 11, to enhance the protection to the items loaded into the hardshell zipper case and the durability of the case, an enhancement element 1202 is placed on both sides of opening zipper 1201, as well as between expanding zipper 141 and hardshell zipper case main body 10. The enhancement element is made of spring stripe for flexibility and compressibility.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An enhanced structure for base with roller and belt of hardshell zipper case, comprising:

a hardshell zipper case main body, designed as a monolithic piece, further comprising a plurality of roller housing trenches, a belt housing trench and at least an auxiliary wheel trench, said roller housing trenches and said belt housing trench being located respectively at a main body bottom of said hardshell zipper case main body, an auxiliary wheel set being placed inside said auxiliary wheel trench, located at said main body bottom, outer rim of said auxiliary wheel set being convex above surface of back of main body;

a plurality of hidden roller units, fastened to inside of said roller housing trenches, said auxiliary wheel set placed inside auxiliary wheel trench being located between said hidden roller units and said main body back, each said hidden roller unit having a roller exposed above surface of said main body bottom when moving, and hidden below surface of said main body bottom when parking;

a retractable belt unit, fastened to inside of said belt housing trench;

a hardshell lid; and an expanding unit, said expanding unit being connected between said hardshell zipper case main body and said hardshell lid, further comprising an expanding zipper and an expanding part.

2. The enhanced structure as claimed in claim 1, wherein said hidden roller unit further comprises a jacket, a positioning bolt, a positioning bolt slider, a sliding axis, a positioning bolt retractable rod, an upper spring, a lower spring, a roller set and a roller;

wherein said jacket further comprising a first positioning bolt fasten hole and a second positioning bolt fasten hole; said positioning bolt retractable rod being placed inside connected said sliding axis and said positioning bolt slider, having said lower spring placed between lower part and said sliding axis and said upper spring placed between upper part and said positioning bolt slider, said positioning bolt being placed on same side of said positioning bolt slider as said first positioning bolt fasten hole and said second positioning bolt fasten hole, all above elements being placed inside said jacket, and bottom of said sliding axis being connected to said roller set with said roller;

wherein by pressing said positioning bolt retractable rod, said positioning bolt slider moving up and said positioning bolt retracting, said entire sliding axis able to slide up and down; when said positioning bolt reaching said first positioning bolt fasten hole or said second positioning bolt fasten hole, pressure on said positioning bolt retractable rod being relieved and said upper spring and said lower spring able to position said hidden roller unit to a desired position.

3. The enhanced structure as claimed in claim 2, wherein when said positioning bolt is fastened to said first positioning bolt fasten hole, said roller is exposed above said surface of said main body bottom and can roll, i.e., non-hidden state.

4. The enhanced structure as claimed in claim 2, wherein when said positioning bolt is fastened to said second positioning bolt fasten hole, said roller is hidden under said surface of main body bottom to avoid damage during handling, i.e., hidden state.

5. The enhanced structure as claimed in claim 1, wherein said retractable belt unit further comprises:

an outer box, a spring roll, a belt, a first fasten element, a second fasten element, an adjustment element and an outer lid;

wherein said spring roll and said belt being placed inside said outer box, said outer lid being fixed to said outer box so as to conceal all above elements placed inside said outer box, one end of said spring roll being fastened to a specific position of said outer box, and the other end of said spring roll being connected to one end of said belt, the other end of said belt being connected to said first fasten element, said adjustment element being placed on a non-specific location of said belt to adjust length of said belt; said second fasten element and said outer lid being fixed to outside of said outer box; pulling said first fasten element also drawing said belt, after pulling said belt out of said outer box to a specific length, said spring roll fixing length of said belt, by drawing said belt around upper part of said hardshell zipper case main body and said hardshell lid to said main body bottom and then engaging said first fasten element to said second fasten element to prevent said hardshell zipper case from cracking; when releasing engagement of said first fasten element and said second fasten element and pulling said belt to a specific strength, said spring roll retracting said belt into said outer box, said outer lid being placed to conceal said entire retractable belt unit and provide protection to said first fasten element and said second fasten element.

6. The enhanced structure as claimed in claim 1, wherein said hardshell zipper case main body and said hardshell lid are made of polypropylene (PP).

7. The enhanced structure as claimed in claim 1, wherein said hardshell zipper case main body and said hardshell lid are made of polycarbonates (PC).

8. The enhanced structure as claimed in claim 1, wherein said hardshell zipper case main body and said hardshell lid further comprise at least an enhancement element, wherein said enhancement element is a spring stripe.

9. The enhanced structure as claimed in claim 8, wherein said enhancement element is located between said hardshell zipper case main body and said expanding unit.

10. The enhanced structure as claimed in claim 8, wherein said enhancement element is placed on both sides of said opening zipper of said hardshell lid.

* * * * *